United States Patent [19]

Rita

[11] Patent Number: 4,757,879

[45] Date of Patent: Jul. 19, 1988

[54] ELECTRICALLY CONTROLLED VALVE APPARATUS

[76] Inventor: Pentti Rita, Poronkatu 4, Mikkeli SF-50190, Finland

[21] Appl. No.: 10,131

[22] PCT Filed: Apr. 30, 1986

[86] PCT No.: PCT/FI86/00043

§ 371 Date: Dec. 19, 1986

§ 102(e) Date: Dec. 19, 1986

[87] PCT Pub. No.: WO86/06359

PCT Pub. Date: Nov. 6, 1986

[30] Foreign Application Priority Data

Apr. 30, 1985 [FI] Finland ..... 851721

[51] Int. Cl.[4] ..... B66B 1/00

[52] U.S. Cl. ..... 187/32; 187/38; 91/448

[58] Field of Search ..... 187/17, 38, 32, 34, 187/35; 91/448, 450, 431, 458, 459, 38; 137/503, 596.12

[56] References Cited

U.S. PATENT DOCUMENTS 4,148,248 4/1979 Risk ..... 187/17

4,418,794 12/1983 Manco ..... 187/17

*Primary Examiner*—Joseph J. Rolla

*Assistant Examiner*—Kenneth Noland

*Attorney, Agent, or Firm*—McGlew and Tuttle

[57] ABSTRACT

An electrically controlled valve apparatus includes an inlet conduit (2) for pressurized fluid, an outlet conduit (12) connected to a tank (T) and an outlet conduit (19) connected to an actuator, or cylinder (5). The valve apparatus comprises a chamber (5) connected to the inlet conduit (2) and provided with two openings (10, 11) each having operating spindles (6, 7). Pressurized fluid flows from the chamber (5) through the two openings via the outlet conduits (12, 19) onto the cylinder and into the tank, or from the cylinder into the tank according to the position of the operating spindles. The valve apparatus also comprises two throttle valves (42) for constricting conduits (52, 53; 40, 45) located between the back chambers (31, 24) of the operating spindles (6, 7) and the fluid tank (T). The operation of the throttle valves is adjusted by means of one or several electric actuators (55). The valve apparatus also comprises at least one sensor (58) for measuring the motional velocity of a lift cage, and a control unit (57), which is employed for adjusting the throttle valves, through the actuators, based on information received from the sensors so that the position of the operating spindles and the fluid flow is regulated such that the lift cage (HS) is moved in a predetermined way.

8 Claims, 3 Drawing Sheets

CONTROL UNIT
P
T
A
B

ELECTRICALLY CONTROLLED VALVE APPARATUS

BACKGROUND OF THE INVENTION

The present invention relates to an eletrically controlled valve apparatus provided with an inlet conduit for the pressurized fluid, with an outlet conduit for a tank or equivalent in order to drain the fluid from the valve, and with an outlet conduit for an actuator proper, such as a cylinder.

In the course of the development of hydraulic elevators, certain important requirements as to their operation have been set forth, among them: a driving speed independent of the load, a stepless acceleration independent of the load, and a slow-down in both directions as well as an approaching speed likewise independent of the load. In addition to this, some manufactures have triied to reduce the amount of required electronics, for instance on grounds that the consumption of electricity should be cut down.

For example, the SE publication of application No. 367,172 introduces a solution which aims at employing two magnetic valves. The said aim is achieved, but as regards hydraulics, the result is an extremely complex valve assembly composed of magnetic valves of the simple on-off type, which either close the respective flow path, or the flow path remains completely open.

In a like manner, the valve construction introduced in the DE publication of application No. 1,268,801 fulfils the above mentioned requirements set forth for the modern technique, but does so by means of hydraulic arrangements even more complicated than in the SE publication. Among other things, the apperatus comprises two magnetic valves of the on-off type, two operating spindles, a precision spindle as well as two throttle valves and a current distributor valve. The latteris needed for driving independent of the load.

The third example is the U.S. Pat. No. 4,418,794. The valve introduced in this publication comprises three operating spindles, one of which is employed steplessly by means of an electric motor, a screw sleeve and a screw bar, as well as an on-off type magnetic valve and one pressure-controlled directional valve. Consequently, this valve arrangement is fairly complex, too, mainly owing to the large number of components of different types.

As a conclusion of the discussion of the publications referred to as representative of the prior art, it is observed that the common aim is to avoid electric components, but this leads to complicated hydraulic arrangements and a disorderly confusion in the resulting technique. None of the described apparatuses, however, is realized without electromagnetic valves, and apart from one, they are of the on-off type. Furthermore, the reducing of electronic elements on the basis that the consumption of electricity should be cut down seems poorly justified, because with complicated valves the current losses in the hydraulics are probably greater than the amount of electricity required by the electronic elements.

SUMMARY AND OBJECT OF THE INVENTION

It is an object of the present invention is to eliminate the above mentioned drawbacks, among others, and to realize a valve apparatus which is simple in structure and reliable in operation. This is achived by means of the characteristic novel features of the invention.

According to the present invention, the old way of thinking has been totally abandoned, and the general ides is to utilize the possibilities offered by modern electronics - which, as regards energy consumption, are absolutely more economical than complicated hydraulics with their current losses. At the same time, the whole way of thinking about valves has been revised. The main idea is to simplify the hydraulics and to achieve orderly clarity in the technical realization of the apparatus itself. Accordingly, only the compulsory operations are left to be carried out by hydraulics, and all that can be done by electric, electronic or similar components, is also done by them.

The apparatus of the invention comprises a chamber or equivalent whereinto the inlet conduit is connected, and which is provided with two openings with operating spindles installed thereinto, through which openings the pressurized fluid has access from the chamber through the outlet conduit onto the cylinder and into the tank, or from the cylinder into the tank, according to how the position of the operating spindles is adjusted with respect to the openings; in addition to this, the apparatus comprises two throttle valves for constricting the conduits between the back spaces of the operating spindles and the fluid tank; an electric or equivalent actuator for reguleting the operation of the said throttle valves; one or several sensors for measuring the motional velocity or corresponding quality of the lift cage; a control unit, by aid of which, for instance on the basis of the information received from the sensors, the throttle valves are adjusted, through their respective actuators, so that the position of the operating spindles, and the hydraulic flows in the openings, which are regulated by the said spindles, are such that the lift cage, the hoist platform or the like behaves in a predetermined fashion.

In another embodiment of the invention, the controlling of the operating spindles of the valve apparatus is carried out by means of one single combined-throttle valve instead of the two separate throttle valves of the first embodiment.

In the valve apparatus according to the first embodiment, the sensors are used for measuring the volume flow of the hydraulic fluid, i.e. the length of the axial movement of the operating spindle, which indirectly means the velocity of the lift cage or equivalent, whereas in the second embodiment the velocity of the lift cage is measured directly by means of a suitable impulse sensor. In both embodiments, the information received from the sensor is processed in the control unit and utilized for controlling the throttle valve or valves by aid of which throttle valves, and through two operating valves, there is adjusted the volume of the hydraulic flow from the pump into the cylinder of the lift cage or of the hoist device and into the tank, as well as from the cylinder into the tank.

Several advantages are achieved by employing the valve apparatus of the present invention, particularly if the invention is applied for regulating the operation of hydraulic elevators. The lift cage can be stopped exactly at the correct floor landing. The creeping distance and velocity follow the given measures accurately. Changs in the load do not affect the said measures. Variations in the temperature of the hydraulic fluid, and the resulting variations in the volume, do not cause erroneous functions and/or creeping; the position of the lift cage is automatically corrected. Inside the lift cage there can be arranged an alarm button whereby the cage can be made to descend to a desired lower floor. It is pointed out that a similar arrangement is not commercially available for hydraulic elevators at the moment, but in alarm cases the lift cage must be descended from the engine room. Moreover, the valve apparatus proper is simple in structure; the number of separate hydraulic elements has fallen to about half of what is normallyb nused. With respect to the size of the valve apparatus, the treated volume of hydraulic fluid is at least doubled in comparison with ordinary valve apparatuses of the corresponding size.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which specific embodiments of the invention are illustrated.

DESCRIPTION OF THE PREFERRED EMBODIMENTS

Figure 1:
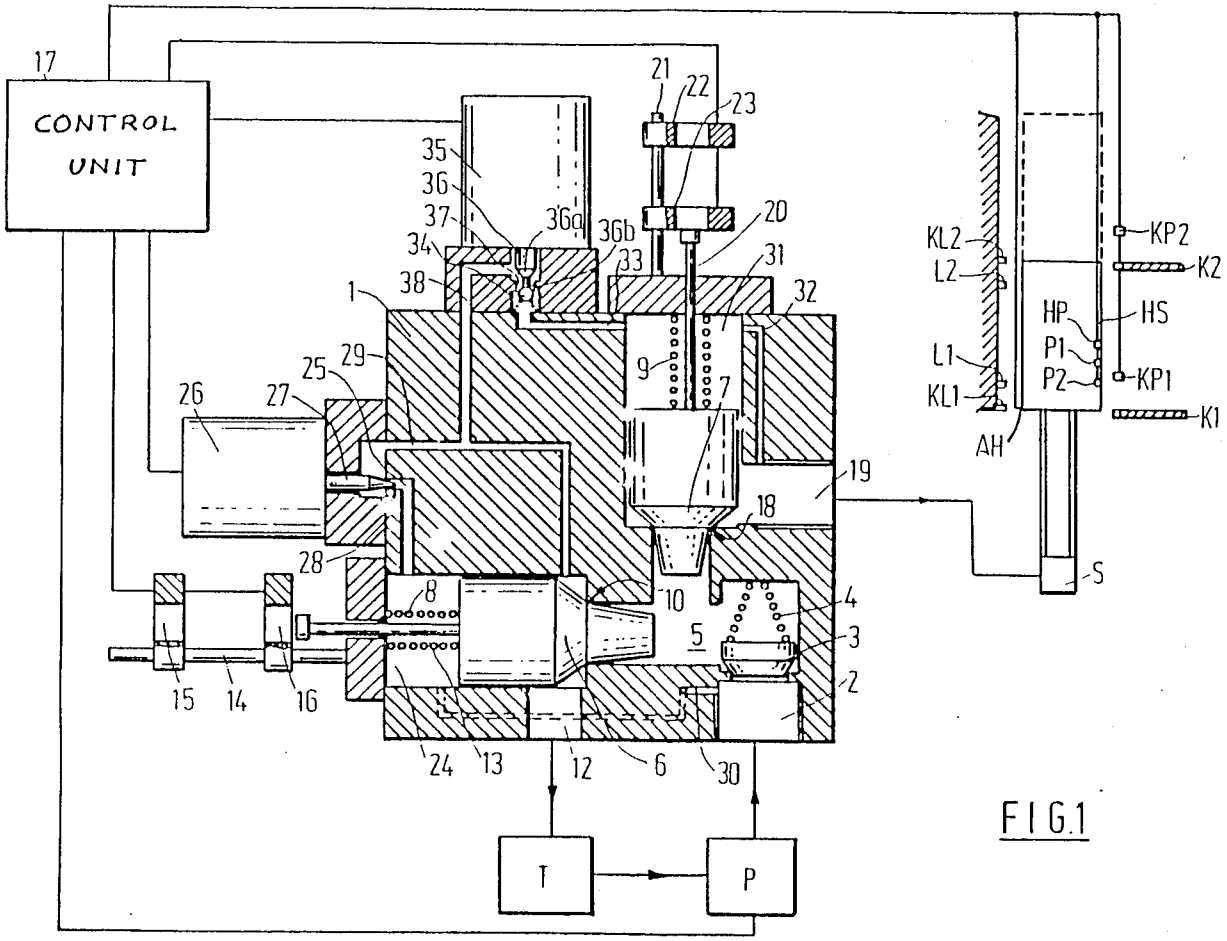
FIG. 1 shows in partial cross-section a valve apparatus of the invention, applied to a hydraulic elevator.

According to FIG. 1, the valve apparatus comprises the valve housing 1, which is provided with an inlet conduit or opening 2, seen from the entering direction of the hydraulic fluid, through which opening the fluid pressurized by the pump P enters the valve apparatus from the tank T. The inlet conduit 2 is provided with a countervalve 3 and springs 4. After passing this, the pressure fluid enters the first chamber 5. By aid of the fluid, the two operating spindles 6 and 7, advantageously charged by the springs 8 and 9, are pressed in the chamber 5. When the spindle 6 is urged against the spring force, a return conduit 12 is opened for the fluid through the first opening 10 directly back into the tank T. In addition to this, the operating spindle 6 comprises a shaft 13 or equivalent which protrudes from the valve housing 1. Similarly, a shaft 14 or bracket protrudes from the valve housing 1, the said shaft being provided with the sensors 15 and 16 attached thereto, which sensors react to the movement of the shaft 13 and thus to the movement of the operating spindle 6 by sending respective impulses to the control unit 17.

From the chamber 24 located behind the first operating spindle 6, a conduit 25 leads to the throttle valve 26, which is electrically controlled. The spindle 27 of the throttle valve 26 is advantageously conical in shape. By employing this valve, it is possible to regulate the fluid flow through the opening 28, from the chamber 24 via the conduit 25 into the conduit 29 which leads into the fluid tank T. Moreover, the chamber 24 is connected to the inlet conduit 2 by means of a conduit 30.

The second operating spindle 7 functions in a similar fashion as the first operating spindle 6. When it is urged by the pressure against the spring power of the string 9, the hydraulic fluid has access through the second opening 18, into the outlet conduit 19, which leads onto the cylinder S serving as the actuator of the elevator HS or the like. The spindle 7 also comprises a shaft 20 or equivalent, and a shaft 21 or bracket protruding from the valve housing, the shaft 21 being provided with sensors 22 and 23 attached thereto, which sensors send impulses to the control unit 17 in accordance with the movements of the spindle 7. Behind the spindle 7, there is located the chamber 31, whereto the conduit 32 leads from the actuator connection, i.e. from the conduit 19. From the chamber 31, there also leads the conduit 33 via the countervalve 34 to the second throttle valve 35, which is likewise electrically controlled. By aid of the spindle 36 pertaining to this valve 35, which spindle is advantageously provided with a conical collar 36*a*, it is possible to close the conduit or the opening 37 on the opposite side of the countervalve 34. The spindle 36 has a pin-like head 36*b*, which is used for opening the countervalve 34 in the conduit 37 before the collar 36*a* of the spindle 36 closes the flow path, i.e. the conduit 37. The conduit 38 leads from the throttle valve 35 directly into the fluid tank T.

In the preferred embodiment of FIG. 1 (as well as FIG. 3), the valve apparatus of the invention is connected to a hydraulic elevator, the actuator whereof is the cylinder S. In this case the lift cage HS is in an exemplary fashion arranged to move between the landing K1 of the first floor and the landing K2 of the second floor. On both floors there are arranged call buttons KP1 and KP2, and the lift cage is provided with respective floor buttons P1 and P2 as well as with an alarm button HP. All buttons are connected to the control unit 17. When the lift cage HS moves from one floor to another, its approach towards the floor landing is observed in conventional fashion by means of the approach signals L1 and L2, and its arrival at the floor landings K1, K2 is observed by means of the floor signals KL1 and KL2 and the sensor AH attached to the lift cage. The use of signals belongs to the domain of the prior art, and it is not discussed further in this connection. Naturally the number of floors and landings where the lift cage HS stops can be larger than above.

The operation of the valve apparatus of the invention is below explained with reference to the velocity diagram of the elevator, illustrated in FIG. 2. The initial position confirms to the situation illustrated in FIG. 1 and is marked by point A in FIG. 2. The elevator HS is on the first floor K1, and the floor button P2 or the cell button KP2 of the elevator has been pressed, i.e. it is desired that the elevator rises to the second floor. The message is registered in the control unit 17. Through the control unit 17, the pump P is started, advantageously first with a small efficiency only. After the pump P has been started, the countervalve 3 is opened due to the hydraulic pressure, and the hydraulic pressure formed in the chamber 5 shifts the first operating spindle 6 to the left and thus allows the fluid flow to enter, via the conduit 12, back into the tank T. The fluid located in the chamber 24 behind the spindle 6 is pressed into the conduit 25, pushes the spindle 27 open and flows along the conduit 29 back into the tank T. When the pump P has been switched to work with full power, the control unit 17 has simultaneously switched a control voltage to the electrically controlled throttle valve 26 and started to observe the sensors 22 and 23. All this time the hydraulic fluid has flown along the conduit 30 from the inlet conduit 2 into the chamber 24 and further along the conduits 25 and 29 back into the tank T.

When the control voltage onto the throttle valve 26 is evenly increased under the control of the control unit 17, the throttle valve 26 pushes the spindle 27 outwards and constricts the opening 28 thus preventing the fluid from flowing through, so that the pressure within the chamber 24 is increased. The operation spindle 6 is shifted, due to the effect of the pressure and the spring 8, to the right towards the seat, thus constricting the opening 10 and decreasing the return flow through the conduit 12 into the tank T. Now the pressure in the chamber 5 increases and starts to affect the other spindle 7. On the other hand, the pressure of the actuator such as the cylinder S which is employed for hoisting the lift cage HS, affects in the conduit 19 and also, via the conduit 32, in the chamber 31 located behind the spindle 7. When in due course the pressure effect of the chamber 5 surpasses that of the chamber 31 and the spring load of the spring 9, the spindle 7 lifts up from the seat and the pressure fluid starts to flow through the opening 18 via the conduit 19 into the cylinder S. The elevator HS starts to rise evenly with accelerating speed, A-B in FIG. 2, because the voltage onto the throttle valve 26 is evenly increased. When the operating spindle 7 is lifted so far above its seat that the shaft 20 has risen to the same level with the sensor 22, this sends an impulse to the control unit 17 which interrupts the increasing of the voltage onto the valve 26. Now we are at the point B of FIG. 2. Consequently it can be maintained that the operating spindle 7 measures fluid flow and the operating spindle 6 regulates the flow during the hoist stage of the lift cage HS.

Figure 2:
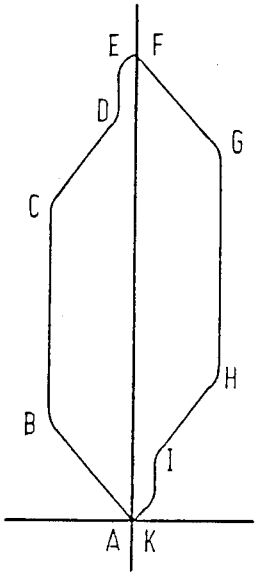
FIG. 2 is a diagram of the lift cage velocity achieved by employing the said valve apparatus.

The lift cage HS is now driven with constant speed to the desired floor, in this case the second floor—the interval B-C in FIG. 2. The voltage of the throttle valve 26 remains constant, in which case the operating spindles 6 and 7 also stay in position. When the aim is approached and the height C achieved, an impulse is sent to the control unit 17 by means of the floor approach signal L2 or equivalent and the sensor AH, whereafter the control unit starts evenly reducing the control voltage onto the throttle valve 26. Now the operating spindle 6 moves slowly to the left, away from the seat, while the spindle 27 of the throttle valve 26 keeps opening the opening 28 and the conduit 25, which causes a constantly growing amount of the hydraulic flow from the pump P to be conducted diretly into the tank T via the chamber 5, the opening 10 and the conduit 12. As a consequence, the pressure in the chamber 5 is reduced, and the operating spindle 7 is shifted downwards towards the seat—i.e. the opening 18 is constricted. Hydraulic fluid does not flow as quickly as before from the chamber 5 via the opening 10 and the conduit 19 into the cylinder S, which means that the speed of the lift cage HS is slowed down. The same development continues until we reach point D in FIG. 2; now the head of the shaft 20 has in reality shifted, along with the spindle 7, to the same level with the sensor 23. The sensor 23 sends an impulse to the control unit 17, which stops reducing the control voltage onto the valve 26. This makes the fluid volume flow onto the cylinder 5 constant, whereby the rising speed of the lift cage HS is also made constant. Thus the cage continues to rise, but at a creeping speed remarkably slower than before—the interval D-E, FIG. 2. When the lift cage has reached the height E, which information is received from the floor signal KL2 and the sensor AH, the pump P is stopped and the power is cut off from the throttle valve 26 after a short time lag arranged in the control unit 17. The time lag prevents the lift cage HS from stopping abruptly.

When it is desired that the lift starts off downwards from for instance the second floor K2 to the first floor K1, i.e. from the point F in FIG. 2 downwards, it is necessary to press either the floor button P1 in the elevator or the call button KP1 located on the first floor. Then the other electrically controlled throttle valve 35 and the sensors 15 and 16 are activated through the control unit 17. With the permission of the control unit 17, a maximal control voltage is fed on the throttle valve 35, so that the spindle 36 of the valve 35 strikes outwards and opens the countervalve 34 by means of its pin-like head **36*b*, simultaneously closing the conduit 37 itself by means of its conical collar 36*a*. Thereafter, under the control of the control unit 17, the reduction of the control voltage in the throttle valve 35 is started in an even fashion, in which case the spindle 36 starts to move inwards and the conical collar 36*a* starts to open the conduit 37. Now the pressure fluid is discharged from the chamber 31 via the conduits 33 and 38 into the tank T. Because the cross-sectional area of the conduit 32 is smaller than that of the conduit 33, the pressure in the chamber 31 is reduced and the second operating spindle 7 is free to rise from its seat, thus allowing the fluid to flow from the cylinder S via the conduit 19 and the opening 18 into the chamber 5. From this chamber, the fluid is discharged into the tank T by pushing the first spindle 6 against its spring 3 to the left, so that the opening 10 and the conduit 12 are opened. When the head of the shaft 13 of the spindle 6 has reached the sensor 15, the speed of the lift cage HS has reached the desired point—i.e. the interval F-G of the FIG. 2. Now the control unit 17 stops the reduction of the control voltage of the throttle valve 35, and the elevator velocity remains at its defined maximum for driving the interval between floors—G-H in FIG. 2**.

When the lift cage HS approaches a floor it is bound to stop, an impulse is sent for the control unit 17 by means of the floor approach signal L1 and the sensor AH. This takes place at the point H of FIG. 2. The control unit 17 starts increasing the control voltage evenly on the throttle valve 35, so that the spindle 36 starts to move and to constrict the flow within the conduit 37. This makes the pressure rise in the chamber 31, the operating spindle 7 to move downwards towards the seat and the opening 18 to be constricted, as well as the operating spindle 6 to shift to the right, away from the seat, and the opening 10 to be enlarged, in which case the speed of the lift cage HS is slowed down, according to FIG. 2, during the interval H-I. When the speed has slowed down sufficiently, i.e. the point I has been reached, the head of the shaft 13 has also settled beside the sensor 16. Now the sensor 16 sends an impulse to the control unit 17, which stops the increasing of the control pressure on the throttle valve 35. The lift cage moves at an even creeping speed during the interval I-K in FIG. 2.

When the floor landing is reached, an impulse is sent to the control unit 17 by means of the floor signal KL1 and the sensor AH. Now the lift cage HS is located at the point K in FIG. 2. The control unit 17 nullifies or switches off the voltage from the throttle valve 35, so that the spindle 36 moves up from the conduit 37, and the countervalve 34 obstructs the flow via the conduits 33 and 38. Now the hydraulic pressure in the chamber 31 rises and urges the second operating spindle 7 down against the seat, thus closing the opening 18 and the flow path from the cylinder S into the tank T. As a consequence, the lift cage HS is stopped. According, at the return stage the operating spindle 6 is employed for measuring the flow and the operating spindle 7 takes care of the regulation of the flow.

As is obvious from the above description, the valve apparatus of the invention is in principle formed of two electro-hydraulic circuits, which comprises the first, electrically controlled throttle valve 26, the conduits 25 and 29, as well as the sensors 22 and 23, and the second electrically controlled throttle valve 35, the conduits 33 and 38 and the sensors 15 and 16. Furthermore, the first operating spindle 6 and the second operating spindle 7 are employed in different tasks, depending on the motional direction of the elevator. Furthermore it is observed that when the pump P is not in operation, the countervalve 34 is used for stopping the lift cage at a determined height. As is apparent from FIG. 1, in the rest position the spindle 36 of the throttle valve 35 is pulled in and the spindle 27 of the throttle valve 26 is pushed out.

As for the technical realization of the sensors 15, 16, 22 and 23, they can be for example magnetic or photoelectric sensors, or other corresponding sensors of a conventional, tried and acknowledged type. Similarly the heads of the shafts 13 and 20 or the members attached to the shafts can form an actively functioning pair together with a sensor, or they can for instance only obstruct a ray of light which passes from the light emitting diode (LED) of the sensor into the phototransistor or equivalent light detector. Furthermore, it is possible to consider a solution where the motion detectors are located in the valve housing 1 proper and react for example to an Fe-structure placed on the surface of the spindle 6, 7. This would make the valve construction remarkably more simple in outlook, and at the same time less vulnerable. On the other hand, when the sensors are located on protruding shafts or corresponding members, the limiting values of the lift cage motional velocity are easily changed by shifting the sensors.

In the above description we have deliberately abstained from going into detail while explaining the technical realization of the electric actuators of the electrically controlled throttle valves 35 and 26, because they can be realized in several different ways. It is possible that the required adjustable, linear motion is created by means of a rotating electric motor, a screw sleeve and a screw shaft, or by means of a linear motor and a spring, or in some other fashion already known in the prior art.

FIG. 3 A introduces another valve apparatus of the invention. In connection to this valve apparatus, the same reference numbers apply in the respective parts as in the embodiment of FIG. 1. The valve apparatus comprises the valve housing 1 provided with an inlet conduit 2 seen in the entering direction of the fluid; through this inlet conduit 2 the fluid pumped from the tank t by the pump P enters the valve apparatus. The inlet conduit 2 is provided with the countervalve 3 and string 4. After passing this, the hydraulic fluid is conducted into the chamber 5 where its pressure is urged towards two operating spindles, the first spindle 6 and the second spindle 7, both being provided with strings 8 and 9 on their opposite sides. When the first operating spindle 6 is urged under pressure against the string power, outwards from the seat, the first opening 10 is opened and simultaneously there is opened the direct return conduit 12 for the fluid back into the tank T. Respectively, when the operating spindle 7 is shifted from the seat against the spring power, the hydraulic fluid has access, through the opening 11, into the conduit 19, which leads onto the cylinder 5 of the lift cage HS.

The second operating spindle 7 is formed of two matched spindle elements *7a* and *7b*. Between these, the first spindle element *7a* covers the large opening 11 of the seat, and the second *7b* covers the small opening 39, which is arranged in the middle of the first spindle. Behind the operating spindle 7 there is located the chamber 31, whereinto the conduit 32 leads from the actuator connection, i.e. from the conduit 19. Also from the chamber 31, the conduit 40 leads out via tahe countervalve 41 onto the throttle valve 42.

The countervalve 41 and the throttle valve 42 are placed in the same valve duct 44, advantageously within a uniform housing 43. The middle part **44*b* of the valve duct 44 is smaller in cross-section than either of its end parts 44a and 44*c*. In the second closed end part 44*c* of the valve duct 44 there is installed the countervalve 41, the string 41*a* and a closure member such as the ball 41*b*. The ball 41*b* rests, under the pressure of the string 41*a*, against the middle part 44*b* of the valve duct 44, so that it closes the valve duct 44. The conduit 45 leads from the other side of the countervalve 41, i.e. from the side opposite to the conduit 40, directly into the tank T or alternatively into the chamber 5 (the dotted line in FIG. 3). The ball 41*b* of the countervalve 41 both prevents and regulates the flow taking place from the conduit 40 via the valve duct 44 into the conduit 45 and the tank T. The spindle 46 of the throttle valve 42 is a bar-like member, the first end 47 whereof is pin-like. After this end 47 comes the extension 48, the conical collar 49, the middle part 50 and the other end 51. The extension 48 is fitted within the middle part 44b of the valve duct 44 so that it prevents all flowing between the conduits 45 and 52. The conical collar 49 of the spindle 46, and the middle part 44*b* of the valve duct, serve as the throttle valve 42 proper between the conduits 52 and 53. The conduit 53** leads into the fluid tank T.

From the back space 24 of the second operating spindle 6, the conduit 52 leads onto the throttle valve 42, and by employing the collar 49 of the spindle 46 of the said valve 42 it is possible to regulate the flow from the space 24 via the conduit 52 into the conduit 53 and further into the fluid tank T. Moreover, the space 24 is coupled to the pump connection, i.e. to the inlet conduit 2, by means of the conduit 54.

In this embodiment of the valve apparatus, the shifting device of the spindle 46 of the throttle valve 42 is the stepping motor 55 with the wobbler 56 attached to its axis, or an equivalent control member. The outlet conduit 19 of the valve apparatus is connected to the employed actuator proper such as the hydraulic cylinder S, whereby the lift cage HS, the hoist platform or the like can be lifted from a landing or floor to another and descended in the like manner.

The velocity and position of the lift cage HS is observed by means of the impulse sensor 58. At the top and the bottom of the lift wall there are arranged runner wheels 59, 60 or equivalent members, over which the wire cable 61 is arranged to slide. The wire cable 61 is attached to the lift cage HS. The wire cable 61 runs through the impulse sensor 58. The impulse sensor 58 comprises the round disc **58*a*, which is rotated by the wire cable 61 moving along with the lift cage. The rotating of the disc is measured for instance electrooptically, and the information is fed into the control unit 57. The lift cage and the separate floors are provided with similar floor and approach signals as in the embodiment of FIG. 1**.

The operation of this valve apparatus according to the present invention is also explained with reference to the velocity illustration of FIG. 2. In the initial position we find overselves in the situation illustrated in FIG. 3 and at the point A of FIG. 2. After starting the pump P, the countervalve 3 is opened, so that the fluid pressure directed to the chamber 5 shifts the operating spindle 6 and allows the fluid to flow via the conduit 12 back into the tank T. The fluid contained in the chamber 24 is pressed into the conduit 52, whereafter it pushes the 35 spindle 46 into open position (direction A) and is drained, via the conduit 53, back into the tank T.

Figures 3A, 3B:
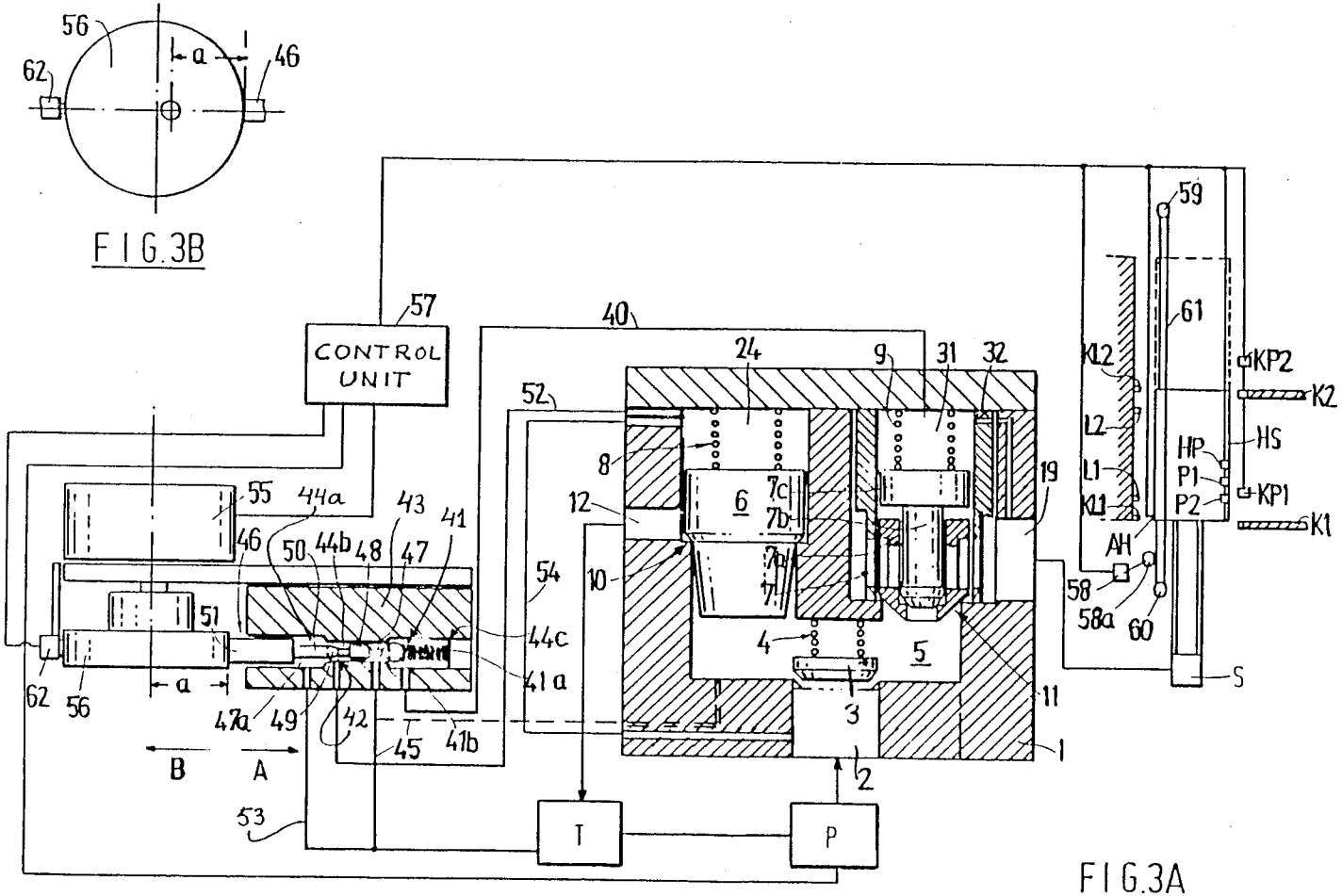
FIG. 3A is an illustration of another valve apparatus of the invention, likewise applied to an elevator
FIG. 3B illustrates the wobbler attached to the stepping motor, seen from the top.

The stepping motor 55 and the wobbler 56 connected thereto are first in home position. The short axis a of the wobbler is now against the spindle 46 (FIG. 3B). This home position is detected for instance by aid of microswitch 62 placed on the opposite side of the wobbler. In this case there can be even an interval between the spindle 46 and the wobbler 56. The spindle 46 is pressed against the edge of the wobbler when the pressure in the chamber 5 is increased. The stepping of the motor 55 is begun under the control of the control unit 57, and the wobbler 56 starts to turn and to push the spindle into the direction B. Now the conical collar 49 starts closing the opening between the conduits 52 and 53. Within the chamber 24, the hydraulic pressure in increasing and pushing the spindle 6 towards the seat and the chamber 5. It closes the opening 10 and the conduit 12 into the tank T. Pressure in the chamber 5 increases. When the pressure has increased sufficiently, the operating spindle 7 (whole of the spindle *7a*) is opened, and the fluid has access into the cylinder S via the conduit 19. It is simultaneously observed, by aid of the control unit 57, whether the lift cage has taken off. When the first motion impulse of the lift cage HS is received from the impulse sensor 58. The acceleration of the lift cage is started. If the first motion impulses come in succession in a series quicker than should be allowed, the stepping motor 55 is stepped backwards, so that the spindle 46 moves into the direction A, i.e. the flow from the conduit 52 into the conduit 53 is increased, and the pressure within the chamber 24 is reduced, and the conduit 12 is slightly opened. This results in a soft and controlled takeoff and initial acceleration of the lift cage during the interval A-B of FIG. 2. As soon as the desired velocity of the lift cage is achieved, which is observed by means of the impulse sensor 58, constant speed is switched on—i.e. the control unit 57 stops the stepping motor 55, the wobbler 56 and the spindle guided thereby are stopped in a given position; the interval between the conduits 52 and 53 remains either totally closed by aid of the conical collar 49, or partly open, in which case part of the fluid can flow from the chamber 5 via the conduit 12 into the tank T.

When the desired interval, for instance between two floors, is driven, the approach signal L2 sends a message in order to start the slow-down—point C in FIG. 2. Now the spindle 46 is shifted into the direction A by employing the stepping motor 55 and the wobbler 56 (or the hydraulic pressure), so that the opening between the collar 49 and the ventilation duct 44b is increased between the conduits 52 and 53, and simultaneously the fluid flow from the chamber 24 into the tank T is increased and the operating spindle 7 closes part of the opening 11 between the chamber 5 and the outlet conduit 19. This procedure is continued, until the speed of the lift cage reaches a certain limit, i.e. the point D in FIG. 2, wherefrom the lift cage is driven forward at the constant creeping speed, until a message is received from the floor signal KL2.

By employing the impulse sensor 58, the floor information is received with the accuracy of +1 mm. The floor information is obstained for example from the lift well, from the edge of the 100 mm wide floor signal KL1, KL2 in the motional direction of the lift cage. The lift cage is stopped by aid of the control unit 57 at 50 mm from the edge of the said signal, whereafter the pump P is stopped.

The timing of the downward drive corresponds to the beginning of the upward drive described above; the pump P is not started, however. The stepping motor 55 and the wobbler 56 are again in home position (FIG. 3 B). In the beginning of the downward drive, the spindle 46 is pushed sufficiently in the direction B by aid of the stepping motor 55 and the wobbler 56, so that the countervalve 41 is opened by means of the pin 47; the hydraulic fluid from the back chamber 31 of the second operating spindle 7 starts to flow into the tank T via the conduit 40, the countervalve 41 and the conduit 45. Thus a difference in pressure is created between the chamber 31 and the outlet conduit 19 or the cylinder S, and this difference starts to lift the inner spindle *7b* of the second operating spindle 7 (the hydraulic pressure can enter the aperture between the inner spindle *7b* and the outer spindle *7a*, as is apparent from FIG. 3) upwards from the seat so that the aperture 39 between it and the outer spindle *7a* begins to open. Pressure in the chamber 5 increases and pushes the first operating spindle up from the seat, so that the opening 10 and the conduit 12 are opened and the fluid starts flowing from the cylinder S via the chamber 5 into the tank T. The acceleration of the lift cage HS, F-G in FIG. 2, is adjusted to be constant by aid of the control unit 57 again on the basis of the impulses received from the impulse sensor 58, so that it remains suitable until the desired descending speed G of the lift cage is achieved (FIG. 2).

By employing the inner spindle *7b*, an excellent controllability of the system is achieved; the takeoff downwards is carried out softly. If the countervalve 41 for some reason is closed (error of the control unit, the stepping motor breaks down etc.), the pressure in the chamber 31 increases, and the inner spindle *7b* begins to close against the seat. However, this takes place in a controlled manner, because there is fluid in between the inner and the outer spindles *7a*, *7b*, and this fluid can flow out both through the opening between the piston *7c* of the inner spindle *7b* and the wall of the chamber 31, and through the opening between the upper end of the outer spindle *7a* and the wall of the chamber 31, both into the chamber 31 and into the outlet conduit 19. Now the lift cage HS stops softly. It is pointed out that while driving upwards, the spindles *7a* and *7b* function as one uniform entity.

The conduit 45 is advantageously connected to the chamber 5. The purpose of this arrangement is to prevent the descending speed of the lift cage HS from growing too fast in case the countervalve 41 should leak or be broken. In that case the hydraulic pressure is now evened out over the operating spindle 7 via the conduits 40 and 45 into the chamber 31.

By employing the valve apparatus of the invention, it is easy to correct the changes and slide-downs that in the course of time take place in the position of the lift cage with respect to the floor landings, which changes are due to the changes in the temperature, and consequently in the volume of the fluid. The impulse sensor 58, by aid of the control unit 57, controls the position of the lift cage with an accuracy of for instance +1 mm. When a sufficiently big change takes place in the position of the lift cage, the control unit starts the pump P, and the lift cage HS is lifted back into its proper position.

In case the lift cage HS should, for one reason or another, stop in the middle of the drive, the control unit 57 returns the stepping motor 55 and the wobbler 56 attached thereto into home position. The general procedure in the case of faults is to return the stepping motor 55 and the wobbler into home position. When the alarm button HP is pressed in the lift cage, the stepping motor, controlled by the control unit 57, winds the wobbler 56 into such a predetermined position where the countervalve 41 is opened, under the pressure of the pin-like head 47 of the spindle 46, so much that the hydraulic pressure in the chamber 31 starts to decrease, but not so much as to lift the inner spindle **7*b* apart from the outer spindle 7*a*. Now the pressure in the cylinder 5 starts to go down, and the fluid flows through the conduit 32, the chamber 31, the conduit 40, the countervalve 41 and the conduit 45 into the tank T. The lift cage HS descends slowly and safely downwards as long as the alarm button HP is being pressed—generally to the nearest floor below, where it is possible to get out of the lift cage HS. Thus it is shown that another task of the conduit 22 is, also while the lift cage HS is rising upwards, to even out the hydraulic pressure of the chamber 31 towards the outlet conduit 19, when the operating spindle 7** rises up from its seat.

If the stepping motor 55 is destroyed, or there is an interruption in the electric supply (the elevator is, however, provided with a reserve power source, i.e. an accumulator) or other fault in the electric circuitry, the countervalve 41 is closed and its spring presses the spindle 46 into the direction A, so that the released wobbler 56 is wound to home position, and simultaneously the lift cage HS is stopped.

Figure 4:
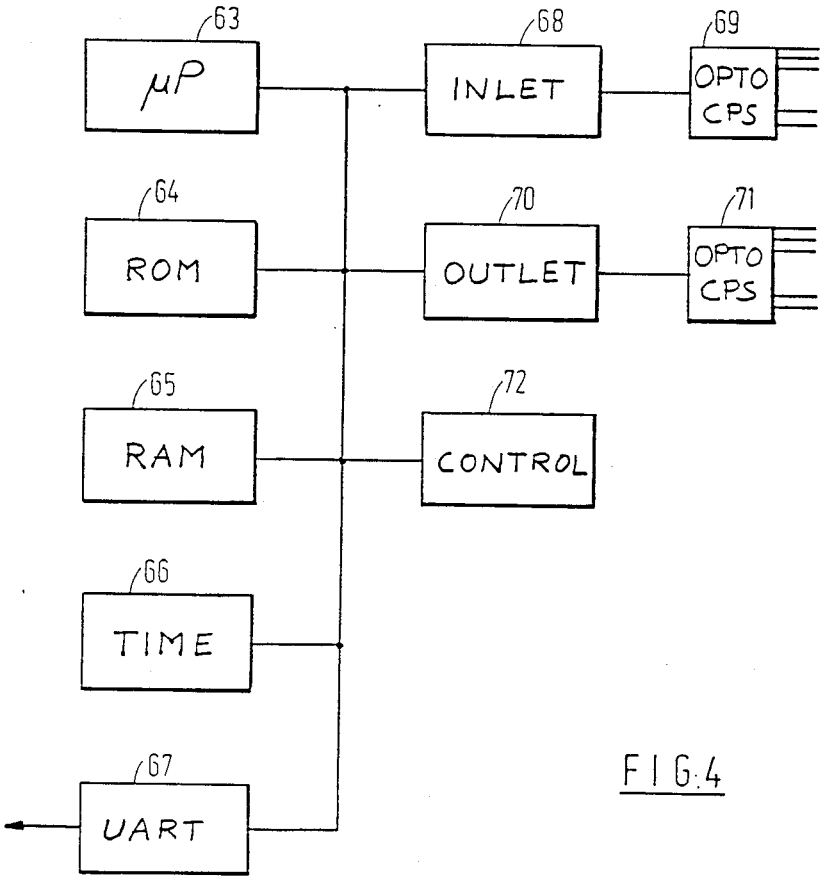
FIG. 4 is a block diagram of a control unit which is suited for controlling the valve apparatus of the invention.

The control unit 57 (as well as 17) comprises advantageously and according to FIG. 4; the data processing unit proper, such as the microprocessor 63; the read only memory ROM 64, where the permanent operating system is stored; the random access memory RAM 65, where the variables and for instance the specific information of each elevator is stored; the timers T 66 for synchronizing the various circuits; an UART circuit 67, whereby the control unit 57 can be connected for instance to external computers; the inlet circuits 68 and the opto-couplers 69 connected thereto, via which couplers the messages from the cell buttons, the floor buttons, the approach and floor signals etc. are transferred to be processed in the microprocessor 63; the outlet circuits 70 and the control circuits connected thereto, for operating the actuator of the throttle valve 42, i.e. the stepping motor 55, for switching the pump P on and off and for giving external alarms etc. and, in addition to this, for example for supervising the control systems of the control circuits 72.

It is pointed out that the inner technical realization of the valve apparatus itself does not necessarily have to resemble the embodiment presented in FIG. 1 or 3, because the conduits and the separate valves can be arranged in many different ways, and their arrangement is mainly dictated by the requirements of the specific application in question, as well as by the manufacturing technique. Thus the above specification is by no means intended for limiting the invention and its scope apart from what is claimed in the appended patent claims.

While specific embodiments of the invention have been shown and described in detail to illustrate the application of the principles of the invention, it will be understood that the invention may be embodied otherwise without departing from such principles.

I claim:

1. An electrically controlled valve apparatus, comprising: a housing defining a fluid chamber, said housing including an inlet pressurized fluid conduit and an outlet pressurized fluid conduit; a tank connected to the outlet conduit for receiving fluid discharged from the outlet conduit; first and second openings in said fluid chamber, each of said openings being fitted with respective first and second operating spindles; an actuator such as a cylinder; second outlet conduit providing fluid connection between said actuator and said chamber, said first and second openings allowing pressurized fluid to flow from said chamber through the first and second outlet conduits to said actuator and to said tank and from said actuator to said tank in accordance with the position of said first and second operating spindles with respect to the first and second openings, said first and second openings and respective first and second operating spindles cooperating to form first and second back chambers; first back chamber conduit providing fluid connection between said second outlet conduit and said second back chamber; second back chamber conduit in fluid connection with said second back chamber and also in fluid connection with said first back chamber and said first outlet conduit; a first throttle valve for constricting fluid flow from said second back chamber to said second back chamber conduit; a second throttle valve for constricting fluid flow from said second back chamber conduit to said first back chamber; and throttle controlling actuator for controlling the operation of said first and second throttle valves; a lift cage drivingly connected to said actuator for movement in an upward and downward direction; at least one sensor for measuring a motional aspect of said lift cage; control means connected to said sensor for receiving sensed information and connected to said throttle valve actuators, for adjusting said throttle valves on the basis of information received from said sensors, so as to position the operating spindles for hydraulic flow through said openings such that the lift cage is moved in a predetermined manner.

2. The apparatus according to claim 1, further comprising: a back pressure valve positioned in said second back pressure conduit, cooperating with said first throttle valve.

3. The apparatus according to claim 1, wherein: said first and second throttle valves are formed integral as a combined multifunction valve.

4. The apparatus according to claim 1, wherein: said at least one sensor includes a first spindle sensor connected with said first spindle for providing position information of said first spindle to said control means, a second spindle sensor connected to said second spindle for providing position information of said second spindle to said control means.

5. The apparatus according to claim 4, wherein: each of said first and second spindles include respective first and second shafts, said first spindle sensor and said second spindle sensor being positioned to sense the movement of the respective first and second spindle shafts.

6. The apparatus according to claim 1, wherein: said at least one sensor includes a sensor for measuring the velocity and position of said lift cage.

7. The apparatus according to claim 1, wherein: said throttle valve actuators comprise stepping motors having a guide such as a wobbler connected to said throttle valve.

8. An apparatus according to claim 1, wherein: one of said first and second spindles is formed of a first spindle member nested in a second spindle member.

* * * * *